US007010897B1

(12) United States Patent
Kuppers

(10) Patent No.: US 7,010,897 B1
(45) Date of Patent: Mar. 14, 2006

(54) LIGHTWEIGHT CONSTRUCTION ELEMENT IN THE FORM OF A HOLLOW BODY CONTOURED HONEYCOMB STRUCTURE

(76) Inventor: Peter Kuppers, Kaiserstiege 143, Gronau (DE), D-48599

( * ) Notice: Subject to any disclaimer, the term of this patent is extended or adjusted under 35 U.S.C. 154(b) by 0 days.

(21) Appl. No.: 09/979,926

(22) PCT Filed: May 25, 2000

(86) PCT No.: PCT/DE00/01683

§ 371 (c)(1),
(2), (4) Date: Dec. 12, 2001

(87) PCT Pub. No.: WO00/73602

PCT Pub. Date: Dec. 7, 2000

(30) Foreign Application Priority Data

May 27, 1999 (DE) ..... 199 24 332
May 10, 2000 (DE) ..... 100 22 742

(51) Int. Cl.
*E04C 2/36* (2006.01)
*B32B 3/12* (2006.01)

(52) U.S. Cl. ..... 52/793.1; 52/793.11; 52/784.14; 52/783.11; 52/783.1; 52/783.17

(58) Field of Classification Search ..... 52/793.1, 52/793.11, 784.14, 783.11, 783.15, 783.17, 52/270, 779, 309.15, 794.1, 592.1, 592.4, 52/789.15, 783.1; 428/116–118
See application file for complete search history.

(56) References Cited

U.S. PATENT DOCUMENTS 4,021,983 A * 5/1977 Kirk, Jr. ..... 52/451
4,453,367 A * 6/1984 Geyer et al. ..... 52/793.1
4,495,237 A 1/1985 Patterson
4,510,725 A * 4/1985 Wilson ..... 52/309.1
4,687,691 A * 8/1987 Kay ..... 428/73
5,016,417 A * 5/1991 Mentken ..... 52/571
5,106,668 A * 4/1992 Turner et al. ..... 428/116
5,233,798 A * 8/1993 Shaw et al. ..... 52/64
5,270,092 A * 12/1993 Griffith et al. ..... 428/69
5,460,865 A * 10/1995 Tsotsis ..... 428/116
5,543,204 A * 8/1996 Ray ..... 428/179
5,588,538 A * 12/1996 Rundle et al. ..... 211/23
5,714,226 A * 2/1998 Disselbeck ..... 428/116
6,003,283 A * 12/1999 Hull ..... 52/783.18
6,176,065 B1 * 1/2001 Honda ..... 52/783.18
6,253,530 B1 * 7/2001 Price et al. ..... 52/793.1

FOREIGN PATENT DOCUMENTS

GB 956 132 4/1964

* cited by examiner

*Primary Examiner*—Jeanette Chapman
(74) *Attorney, Agent, or Firm*—James Creighton Wray; Meera P. Narasimhan

(57) ABSTRACT

A construction element 1 consists of multiple individual layers 2, 3, 4 whereas the medium layer 3 is in turn composed of a multitude of additional individual layers 23, 24, 25. The individual layers 2, 4, 23, 24, 25 are configured in such a way that they interlock and clamp into each other thereby producing or defining surfaces that allow the elements or individual layers 2, 4, 23, 24, 25 that are integrated in the construction of the construction element to evenly absorb the forces that are being applied. At the same time, not only pressure or lateral forces but also tensile and transverse forces can be absorbed so that altogether a construction element 1 with a low weight but high stability has been created. This construction element 1 can be shaped or deformed appropriately and can also be extended three-dimensionally so that an adaptation to the individual conditions in any plane or direction is possible.

22 Claims, 8 Drawing Sheets

LIGHTWEIGHT CONSTRUCTION ELEMENT IN THE FORM OF A HOLLOW BODY CONTOURED HONEYCOMB STRUCTURE

BACKGROUND OF THE INVENTION

The invention concerns a construction element, which is composed of multiple individual layers of which at least one individual layers features a honeycomb structure.

Known are construction elements in the shape of sheets of material where the honeycomb structure as well as the two cover sheets can be made of paper or cardboard. The honeycomb structure, similar as the natural honeycombs, rests with its almost vertical inner walls on the cover plates so that sheets are created that feature increased stability and advantageous low weight. Doors can be manufactured from the appropriate sheets of material. The sheets can also be used in interior construction or convention construction (DE-OS 197 48 192.2). It is a disadvantage that the entire construction can be effected by moisture. It is also a problem to design the edges with an appropriate reinforcement because they have to be independently connected with the other parts of these known sheets of material. From the DE-OS 19 22 693.8 a procedure and construction element is known which is also built in a sandwich-like fashion. The two cover plates are made of metal and the cell walls in between or the corresponding honeycomb structures are connected with the cover plates through welding or soldering whereas especially the soldering material is guided in a way that it sets into the corners of the cells and thus connects the cover plates especially well with the honeycomb structure. In spite of the reinforcement of the cell corners, the main characteristics remain the same in that the almost vertical inner walls rest on the two cover plates and thus have to transfer the forces that they are to absorb. Therefore, with such lightweight honeycomb structures the stability is almost exclusively dependent on the cover layers. The individual stability of the sandwich center is on the other hand neglectably small. Another disadvantage is the relative extravagant manufacturing process as well as the use of different materials and the impossibility to use plastics.

SUMMARY OF THE INVENTION

The invention therefore has the task to create a construction element with minimal weight and favorable characteristics in terms of stability and insulation.

The task is solved according to the invention by the fact that the individual layers are built as a sheet as a part of the honeycomb structure or a foil as a part of a honeycomb structure with a very thin wall, which features a basis construction and positive and/ or negative protruding hollow bodies or partial hollow bodies that are shaped to interlock when inserted into each other and/ or that are shaped to hook into each other and that distribute forces evenly onto all honeycomb elements by designing and placing the embossed individual layers so that they build one wall with the neighboring individual layer in the connection area along one surface.

Differing from the state of technological development today, in this case, all elements participate to the same extend in the absorption and distribution of forces so that the characteristic or the stability of the cover plates is no longer a factor. Moreover, the entire construction element carries forces continuously evenly, so that it is possible to create vertical as well as horizontal or also diagonal running walls and construction elements or to realize them. Independent from the individual arrangement of the construction elements, all individual layers or better, all parts of the individual layers, participate in the absorption and distribution of forces and ensure that overall a construction element is available that offers high stability values while having a very low weight and that in addition offers optimal sound and temperature insulation. The latter participates especially, due to the fact that the individual single layers either feature hollow bodies or partial hollow bodies or together build them whereas the air that is trapped in the hollow bodies serves as an optimal insulator against temperatures as well as sound. Another advantage is also the fact that such a construction element can not only absorb vertical forces but also pressure forces or other usually differing forces without requiring an increase in the thickness of the wall or other measures. The corresponding hollow bodies or partial hollow bodies can in addition be used to hold gas, liquid or other material and thus create a fire wall which makes its use possible under extreme conditions. The individual construction element is manufactured from individual interlocking single layers, which enables the possibility to create a construction which due to its surface design on one hand and due to its corresponding shape on .the other hand makes it possible to create walls with practically any thickness or in other words with hollow bodies that touch each other to create the advantages that were described previously. Attractive is especially the low weight of such construction elements and the high stability that is also achieved through the succeeded flat connection and the building of stable walls.

A corresponding construction of such construction elements is especially achieved by the fact that the hollow bodies or partial hollow bodies are designed to correspond with the hollow bodies or partial hollow bodies of other individual layers thus creating the middle individual layer with its individual layers and the in turn corresponding surfaces between each other. The corresponding partial hollow bodies or hollow bodies become corresponding hollow bodies or even enclosed hollow bodies when the corresponding individual layers are inserted into each other or set into each other as previously described. The separately manufactured individual layers, which will be described in greater detail at a later point, correspond to each other in such a way that they feature the individually described partial hollow bodies or hollow bodies and create them when put together. The individual layers, or also the hollow bodies or partial hollow bodies, feature very thin walls, whereas previously it was indicated that they can for example be designed as honeycomb foil. These individual, thin-walled honeycomb structures are being combined with the extensions and completed by setting them into each other or inserting them into each other so the touching of surfaces of the individual hollow bodies or partial hollow bodies enables a good distribution of forces and also an additional stabilizing of the entire construction element.

It is especially useful, when the hollow bodies or partial hollow bodies that correspond with the individual layers are shaped to form a pyramid or a mirrored double pyramid when they are set into the other individual layers. This pyramid shape has the advantage that four or more surfaces are available onto which the neighboring pyramid or hollow body or partial hollow body can be attached and set flush in order to ensure an extensive absorption of forces. The pyramid can be formed to stand, lay, or otherwise or can be shaped when the individual layers are being attached without having to worry that the stability of the entire construction element would be lessened.

It is useful that the pyramids that are organized and built by the individual layers of partial hollow shapes or hollow shapes in such a way that neighboring pyramids or mirrored double pyramids that are also built by inserting the layers are attached to create a flat surface, whereas a cross wall is created by the flat connection of the individual layers which can absorb forces coming from all sides. In addition, it can be pointed out again that the pyramid shape is especially well suited to ensure a flat attachment of the individual pyramid parts onto each other. The surfaces of the individual pyramids all are used to attach neighboring pyramids of the same or from different individual layers so that already the description shows that this creates an optimized construction shape that has the previously described characteristics of a low weight and high stability. An advantageous cross walling has been created that can absorb forces from all sides.

For the normal case scenario it is advantageous, when five individual layers are fitted to create one combined element whereas the middle layer serves as an individual layer that features positive and negative partial hollow bodies and which has been assigned an intermediary individual layer on both sides and then an individual layer that features partial hollow bodies on one side. The individual layers are fitted together or inserted into each other, as stated in the description, so that they build one construction element that is stabilized in its entirety and which ensures especially through the pyramid surfaces a favorable transfer or absorption of the appearing forces. Differing from the up until now common sandwich-like components are the outer individual layers which could here in some respect be described as cover plates which are also integrated to increase the stability by also equipping them with corresponding hollow bodies or partial hollow bodies on their lower surfaces which form a construction with those situated between the individual layer and the intermediary layer, a feature that then guarantees the desired stability characteristics. Because the hollow bodies or partial hollow bodies correspond with the 'cover layers', transverse forces or other unusual forces can be absorbed without a problem because those forces can be guided from the 'cover layers' into the middle layer or inserted individual layers so that a safe absorption or transfer is possible. Because the 'cover layers' have been assigned no stability task or at least no individual or exclusive stability task, it is possible, to design the entire combination element in curved shape or rounded in an other way, because two outer individual layers are fabricated from the same thin-walled material as the inserted individual layers.

A honeycomb structure or better hollow body structure that is three-dimensionally extendable can be realized due to the fact that one or both middle individual layers are assigned an adapter-single layer or that the connecting middle layer is assigned adapter-single layer construction elements on both sides in any height and or width that create the three-dimensional construction. The individual adapter layers make it possible to add a corresponding construction onto the middle layer so that the construction element can be expanded skillfully and purposefully in a three-dimensional fashion. Here, an even force transfer is also ensured, so that no matter at which point a force attacks, this force can be evenly distributed onto all elements whereas this combination creates the possibility to build entire walls with any desired thickness.

The three-dimensional expansion of the construction element is further enabled by the fact that the individual adapter layer features in turns positive hollow bodies or partial hollow bodies and gaps. Therefore, for example a middle layer together with individual adapter layers on both sides can be built up or constructed to become an 'individual layer' that acts as an outer individual layer by which the corresponding, added three-dimensional build-up is realized.

The solidity of the construction element can according to the invention be varied by the choice of material whereas the invention intends that the individual layers consist of paper saturated with liquefied plastic, of aluminum, steel or plastic foils. At the same time, the corresponding individual layers feature a wall measuring a thickness with a $\mu$-value, as previously mentioned, whereas this is clarified with this invention by using the term 'foil'. Depending on its use, the construction elements can be created to exactly suffice the intended purpose which gives the opportunity to create optimal construction elements as far as price as well as stability value goes. It is thinkable, that the individual layers consist of woven foils, preferably plastic threads or material that consists of different fibers in order to adapt the stability solidity characteristics and thus also the stability values according to the individual operational conditions.

The corresponding hollow bodies or partial hollow bodies are to optimally rest flat on each other according to the invention whereas the areas in between the pyramids, as will be further detailed later, add to the effect. Those stable individual layers, however, can, according to the invention, be bent or tilted into the appropriate shape because, according to the invention, the edges that lead to the top of the pyramid are perforated and or slit. Under appropriate pressure, this perforation or slit does not represent a problem, because the surfaces still touch each other and ensure the appropriate transfer or absorption of the forces. The perforation or slit enables bending also in the area of an individual pyramid without resulting in a deformation of the pyramid or the corresponding hollow body.

Another useful design intends that the hollow body with slanted surfaces which form the honeycomb structure is positioned preferably in a beveled position on an edge. The slanted positioning of the surfaces is optimal because this way the entire hollow body can be integrated in the line of force without resulting in different pressures in partial areas of the hollow body. The hollow bodies are positioned with their slanted surfaces touching each other and transfer the incoming force or ensure an optimal distribution and therefore the use of the full capacity of the entire honeycomb structure and thus ultimately also of the corresponding construction element.

The outer individual layers of the invented construction element no longer work or serve as a cover layer. Moreover, they are integrated in the entire construction element. Nevertheless, a smooth outer design is possible due to the fact that the outer individual layers feature hollow bodies or partial hollow bodies on their inner side and a flat cover on their outer side. The flat cover enables the stacking of corresponding construction elements whereas then, however, this sacrifices the interlocking of the construction elements. Such designed construction elements are advantageous especially for example with the manufacturing of room dividers or similar objects.

The outer individual layers also consist of the same material with the same wall thickness as the other individual layers so that the outer individual layers can completely participate with the movements or better, shapes of the other individual layers. This can be supported by using a flexible material or material that makes the upper and lower individual layer flexible. For example, it is thinkable here, that a softer synthetic material is used for the outer individual layers than for the other individual layers.

Once that individual construction element received its intended shape, it can be useful to connect the various individual layers with each other whereas this can be especially achieved by the fact that the hollow bodies or partial hollow bodies form the honeycomb structure and are permanently or detachably connected with each other, preferably welded together, glued, screwed or connected via frictional energy. As can be seen with this statement, the individual form can also be created with this connection and thus can then be created in the same fashion.

The useful pyramid shape for the individual hollow bodies or partial hollow bodies has already been discussed. In addition, the invention intends that the hollow bodies or partial hollow bodies of the individual layers are shaped as a pyramid and the hollow bodies that create the honeycomb structure are shaped as double pyramids or a mirrored double pyramid. These double pyramids or better mirrored double pyramids support each other via the lower edges and therefore build a stable three-dimensional object which optimal serves the described and required tasks. At this point, a glued, screwed or otherwise created connection is possible in order to connect the pyramids or double pyramids effectively with each other and to attach them to each other.

The high stability of such construction elements is ensured by the fact that elements that are part of the honeycomb structure rest on each other extensively whereas also the edges or the parts of the basis construction that touch each other can be integrated by the fact that the pyramid-shaped hollow bodies or partial hollow bodies at the basis construction are held at a distance from each other building a place holder stripe while the segments of the double-pyramid-shaped hollow bodies are connected with each other via a stripe at the edges that run parallel to the middle axis. Thus an extensive support is ensured also on those areas instead of the previously used linear support.

The stability of the entire construction element is therefore purposefully increased. The insertion of the individual segments of the double-pyramid-shaped hollow bodies or the honeycomb structure sheets and the safe extensive support is facilitated by the fact that the tops of the segments of the double-pyramid-shaped hollow bodies or the partial hollow bodies are flattened. Thus an insertion of the honeycomb structure sheets is facilitated and an interlocking is made easier.

An exact support of the pyramid tops in addition to the surfaces of the cooperating pyramids or mirrored double pyramids that rest on each other is achieved according to the invention by the fact that the flat piece on the top of the pyramid or mirrored double pyramid corresponds with the place holder stripe and/or the stripe along the edge and is designed to ensure an extensive support. The top is also integrated in the extensive support construction by designing the flattened piece purposefully—as described—in such a way that the pyramids or the mirrored double pyramids fit exactly in or on the place holder stripe or the stripe along the edges.

An advantageous compensation of forces or a flexible construction element is created, when the hollow bodies or the surfaces of the individual layers are connected via a flexible material to build one wall. Depending on the thickness and type of the elastic material, the individual layers or the hollow bodies can 'move' without losing stability. This design brings advantages especially with hollow body honeycomb structures that consist of only a few individual layers. Blows can be absorbed, even the impact of stones can be compensated.

To insulate, to retain fires and to serve other reasons, it can be useful, to fill the hollow bodies partially or completely with a gaseous or liquid medium after the connection has been established whereas an exchange between the individual hollow bodies can be achieved via gaps in the walls. The type of 'filling' depends on the operational purpose.

Advantageous is also a further development with which the so-called neutral fibers of the extensive connections are connected with the next neutral fiber and where the intermediary layers build the spaces in between whereas their surfaces also receive a connection.

The invention is especially characterized by the fact that all elements that contribute to the construction of such a honeycomb structure are involved in the absorption of the force that are applied onto the construction element. This means, that the forces are being absorbed on the outer level and than transferred to the elements thereafter, that means the individual layers and their individual components. Thus, the individual elements of such a construction element are together responsible for the stability of the entire construction element. The cover layers or the outer individual layers do not need to be designed specifically stable, but feature the same wall strength like the other individual layers and usually consist of the same material. However, they are not only simple in their construction but they also don't hinder the shaping of the entire construction element any longer because they can be bent together with the middle individual layers or formed otherwise in order to give the construction element its desired shape. Also, from their 'interior design', the individual layers are designed so that an appropriate shaping of the entire construction element is possible. The individual hollow bodies or partial hollow bodies feature slits on the corners that lead to the top of the pyramid or are otherwise weakened so that they don't resist the appropriate shaping. It is especially advantageous that with the help of the appropriate individual layers construction elements are created with practically any wall strength, while keeping the weight excellently low. In addition, it is possible not only to adapt the entire wall strength of such construction element to the individual conditions but also their extension in a plane because the individual layers are interlocked with each other, arranged and set up in such a fashion that it is possible without seams to realize extensive construction elements. Thus, a three-dimensional construction method has been created and is possible which is not thinkable with any other construction element. Finally, it is another advantage that it is possible with such construction elements to use a variety of materials in order to enable an adaptation to various tasks.

Additional details and advantages of the invented object can be found in the following description of the corresponding drawings where a preferred design example is depicted with the necessary details and individual parts.

It is shown in:

DETAILED DESCRIPTION OF THE PREFERRED EMBODIMENTS

Figure 1:
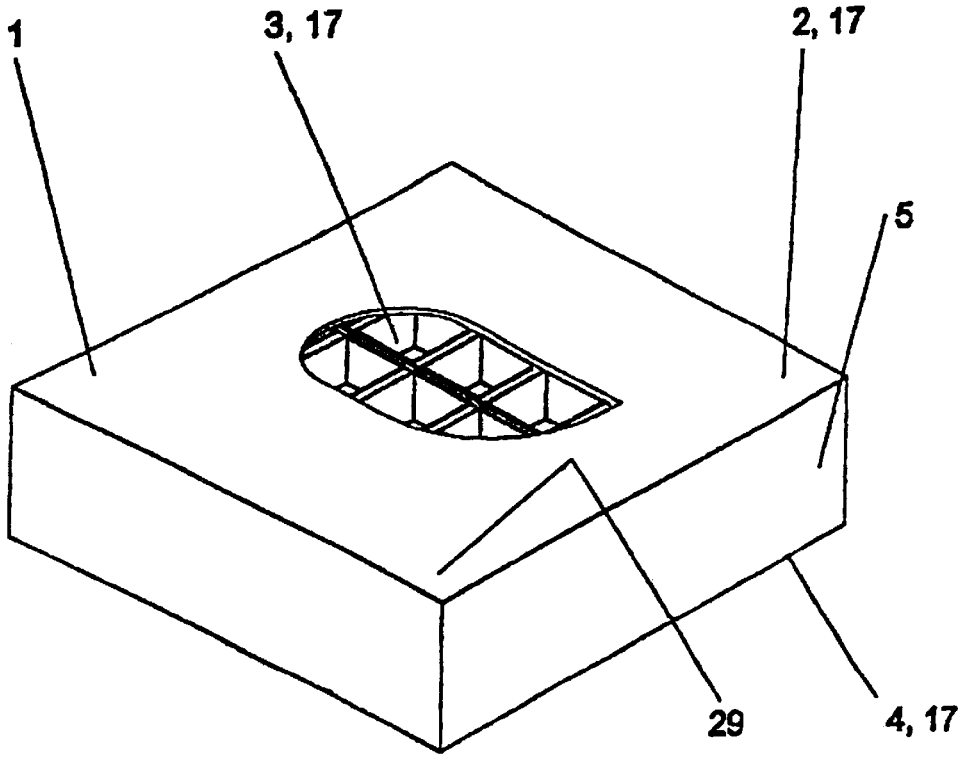
FIG. 1 construction element with interior honeycomb structure.

FIG. 1 shows a construction element in its finished form. The upper outer individual layer 2 is partially open, to make the honeycomb structure 3 visible. The honeycomb structure rests on one side on the upper outer individual layer 2 and on the other side on the lower outer individual layer 4. The honeycomb structure 3 is depicted here in a simplified way. Subsequently, the individual layers 2, 4 are designed to be integrated.

The outer part 5 of the construction element as well as the outer individual layer 2 are seen as a smooth level, which is achieved by attaching a cover 29 onto the outer part and the outer individual layer 2.

The honeycomb structure 3 consists of a multitude of individual layers 23, 24, 25 with hollow bodies 7, 8, 9 or partial hollow bodies 26, 27; the corresponding elements can also be found in the following figures. Hollow bodies 7, 8, 9 have protrusions extending above (positive) and/or below (negative) individual layers 2, 4, 23, 24, 25.

The outer individual layer 2 as well as the outer individual layer 4, and the inserted honeycomb structure 3 with the appropriate individual layers 23, 24, 25, consists of partial honeycomb plates with a low thickness of their walls. This honeycomb structure sheet 17 is commonly built as a partial honeycomb structure foil, and therefore, features a wall thickness with a $\mu$-value.

Figure 2:
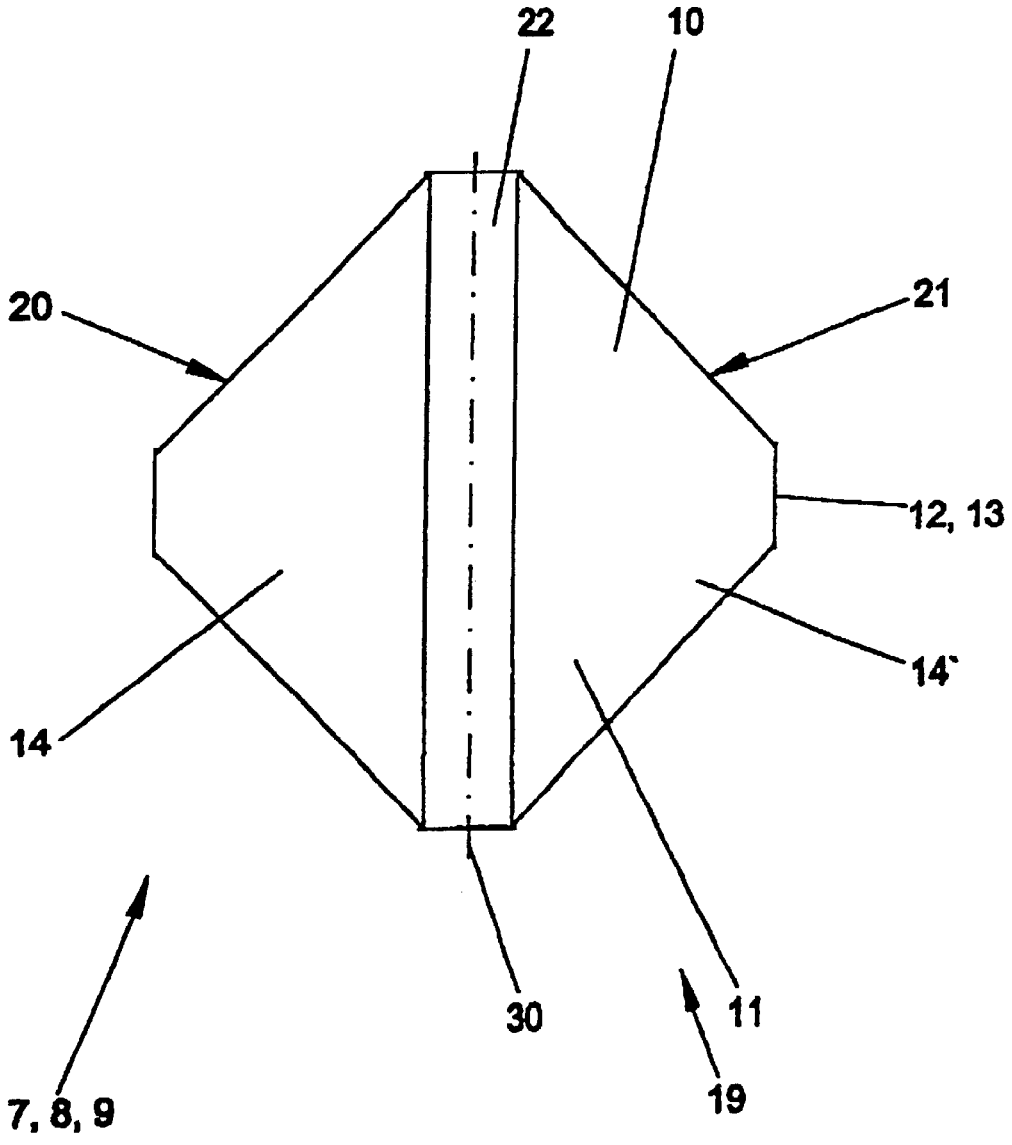
FIG. 2 a hollow body in the shape of a double pyramid in side view.
Figure 3:
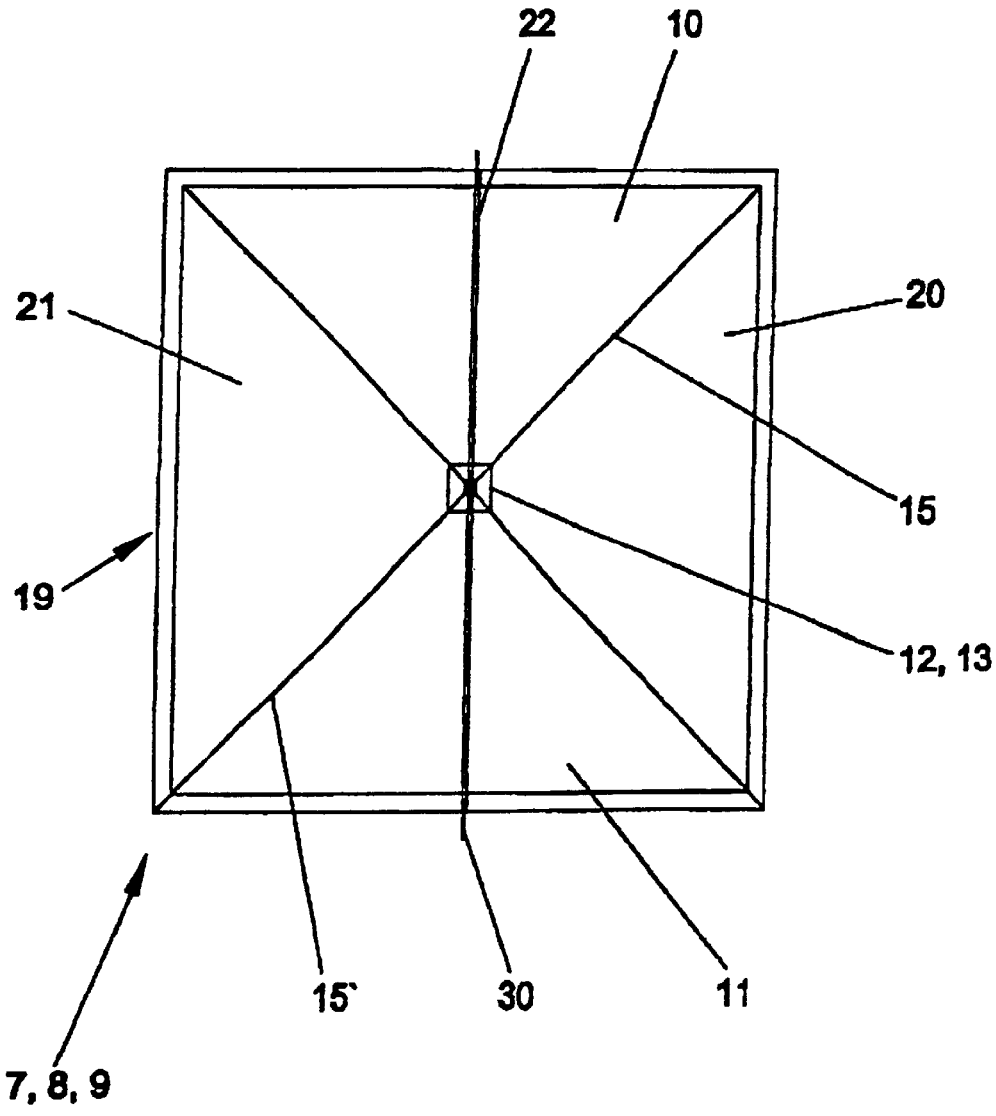
FIG. 3 a double-pyramid-shaped hollow body shown from above.
Figure 6:
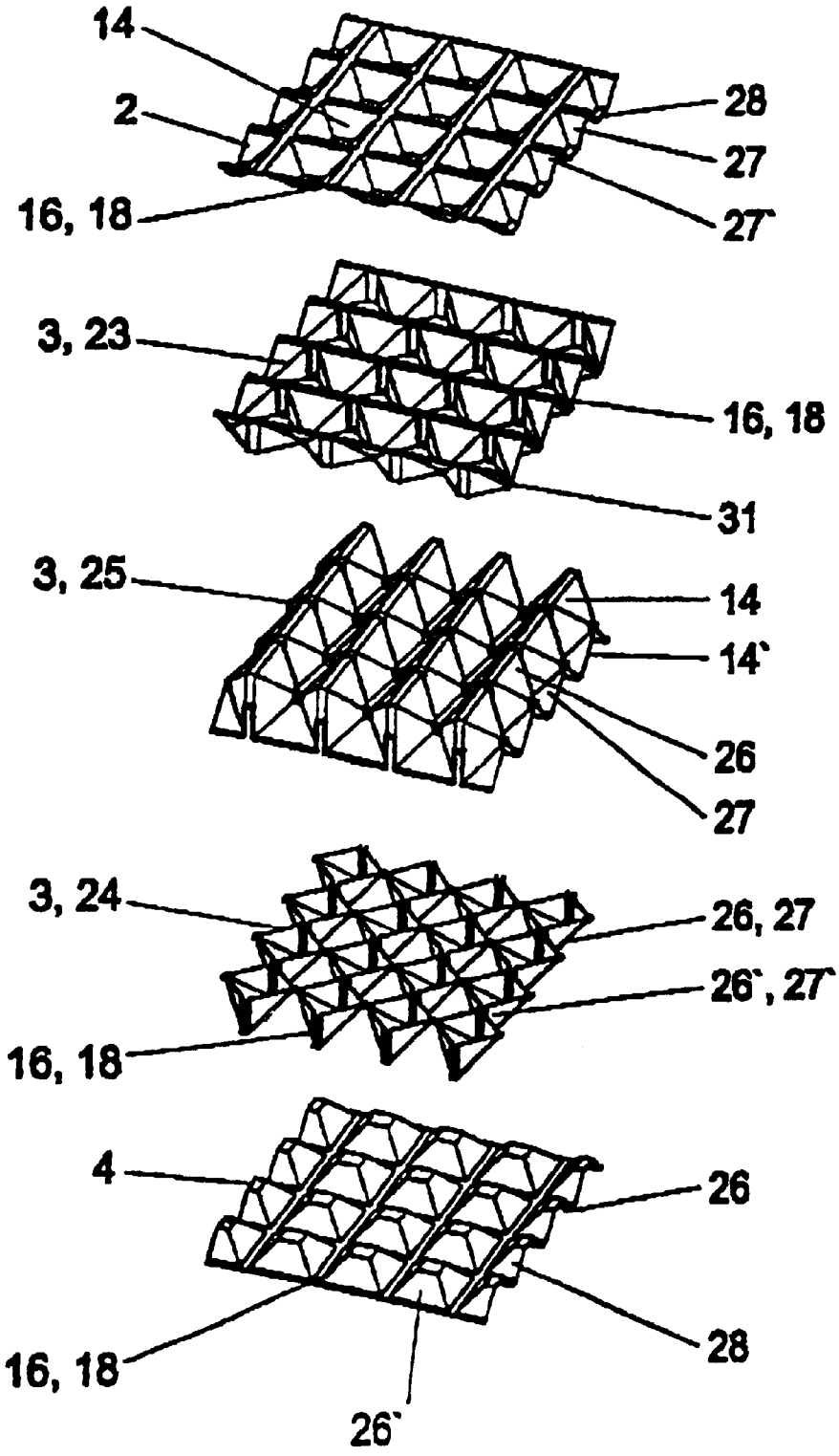

The honeycomb structure 3, or the individual layers 2, 4, 23, 24, 25, are shaped with hollow bodies 7, 8, 9 according to FIGS. 2 and 3 or partial hollow bodies 26, 27 according to FIG. 6. The hollow bodies 7, 8, 9 and partial hollow bodies 26, 27 are not distinguishable because when the individual layers 2, 4, 23, 24, 25 are put together, hollow bodies 7, 8, 9, as well as partial hollow bodies 26, 27, are built to altogether lead to the honeycomb structure 3 or to construction element 1.

The individual hollow bodies 7, 8, 9 according to FIG. 2 and 3 usually build pyramids 14, 14' or mirrored double pyramids 19. Hollow bodies 7, 8, 9 have individual segments 20, 21 along all sides of the pyramids 19. Partial hollow bodies 26, 27 have individual segments disposed between open areas or gaps (see FIGS. 6–9) in a pyramid. The individual segments 20, 21 serve to achieve and ensure an altogether extensive support of the individual elements of the honeycomb structure of each other. As seen in FIGS. 2 and 3 and the additional figures, the pyramids 14 or the mirrored double pyramids 19 are especially well suited for such an extensive support of the individual elements because surfaces 10, 11 are available that are appropriately off set to each other. Also, the surfaces are large enough such that the corresponding forces that are being applied onto the construction element 1 can be safely absorbed and transferred.

The mirrored double pyramid 19 consists of the two pyramids 14, 14' which are connected with each other via a bridge coupling 22. The middle axis 30 separates both elements or in other words they are connected along this middle axis.

On the tops 12 of the individual pyramids 14, 14', flattened surfaces 13 are intended to facilitate an additional beneficial support of the individual parts or individual elements onto the strip along the edge 31 or the place holder 18 or better the basis construction 16.

While the 'separation line' on FIG. 2 fits the two pyramids 14, 14' together to form one mirrored double pyramid 19, the middle axis 30 according to FIG. 3 at the same time is the line of separation which leads through the flattened tops 12. Not visible is that the edges 15, 15' are designed to allow a perforation or a slit in order to facilitate a bending of the appropriate individual layer and also of the entire construction element 1 without requiring excessive force.

Figure 4:
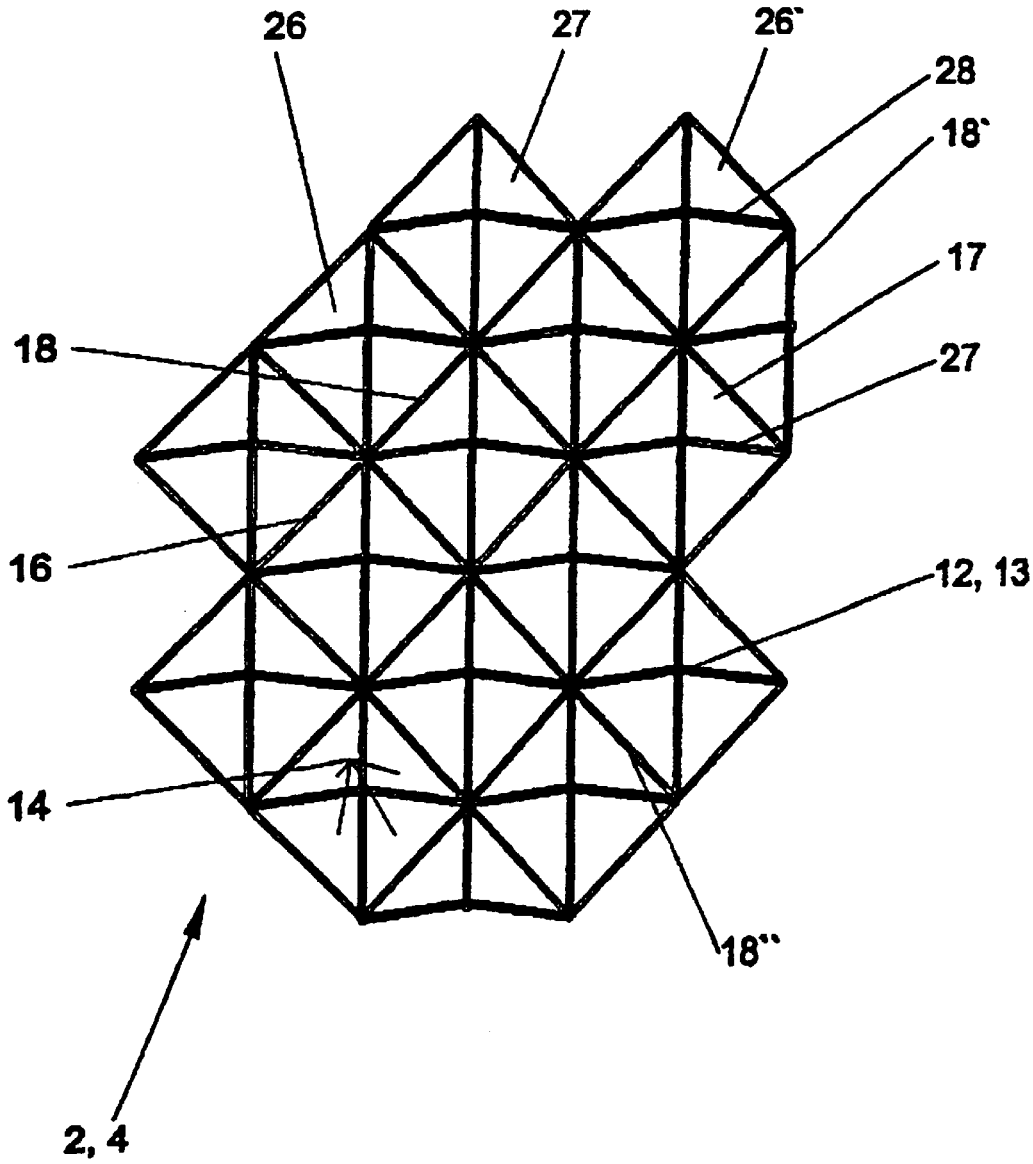
FIG. 4 a view onto an outer individual layer from the inner side.

FIG. 4 shows an outer individual layer 2 or 4 which features on its inner side 28 hollow bodies 7, 8 or pyramids 14. These individual pyramids 14 are all equally measured and connected with each other via the basis construction 16. This basis construction 16 at the same time builds the place holder strips 18 which ensure that for once the individual pyramids 14 are place in equal distances to each other and also that the partial hollow bodies 26, 27 or 7, 8, 9 that form when that individual layers 2, 4, 23, 24, 25 are pushed together, their tops 12 can rest on those place holder strips 18. The stability of the corresponding entire construction of the construction element is thus optimized.

By using the same expression 18 for all basis constructions 16 that run between the pyramids 14 it is clarified that all are to feature the same measurements. They are labeled with 18' and 18".

Figure 5:
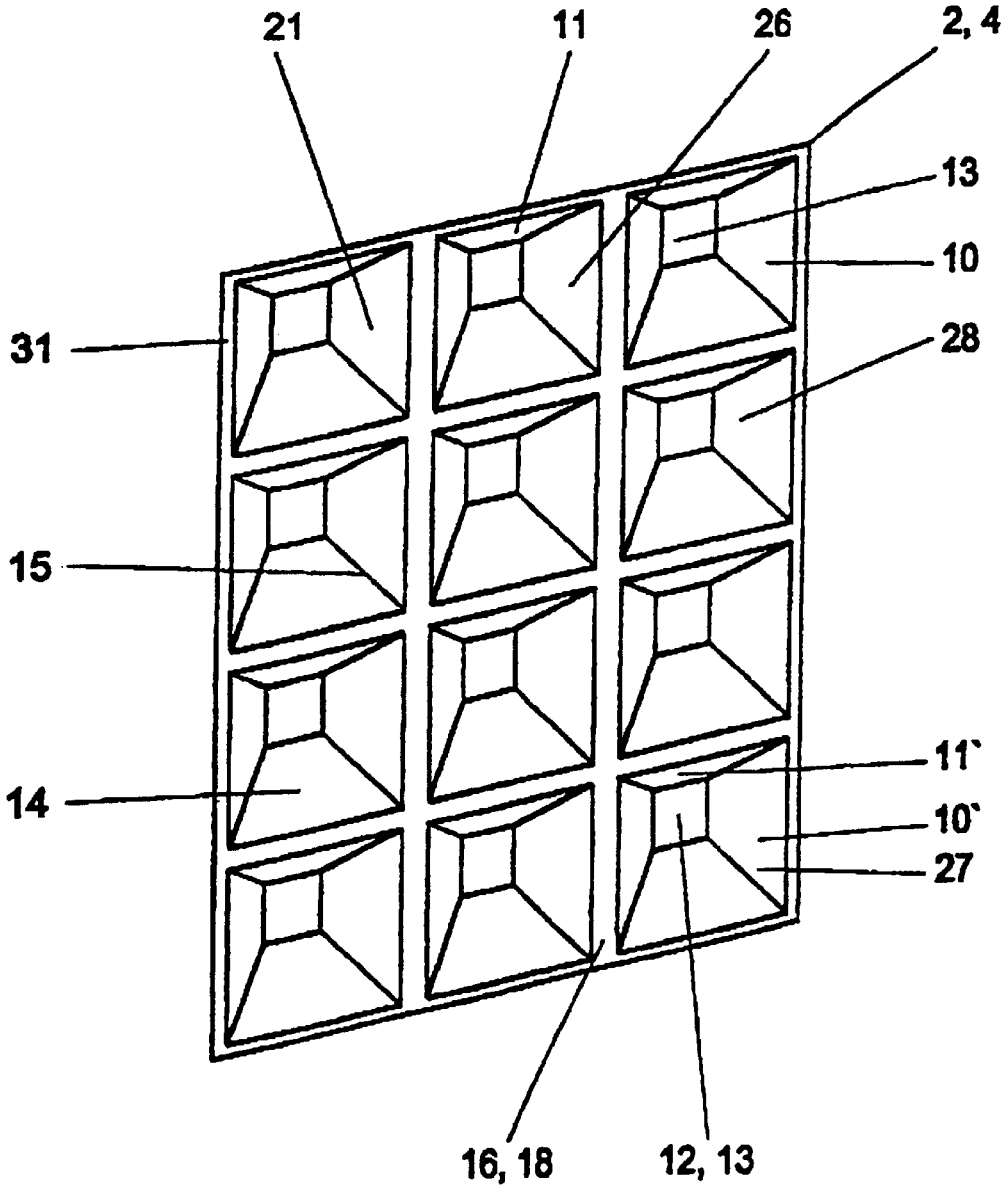
FIG. 5 a perspective drawing of an inner view of the outer individual layer according to FIG. 4, FIG. 6 an explosion drawing of a five-part construction element FIG. 7 a construction element according to FIG. 6 shortly prior to the insertion or the interlocking of the individual layers, FIG. 8 a perspective drawing of FIG. 7 and FIG. 9 an explosion drawing of an eleven-part construction element with an adapter individual layer to connect the individual layers.

FIG. 5 corresponds in principal with the depiction according to FIG. 4 except that a perspective is here shown that clarifies at the same time that the corresponding surfaces 10, 10', 11, 11' are all part of the support of each other and thus part of the transfer of experienced or applied forces. The corresponding pyramids 14 that are formed on the inner side 28 feature the same shape and thus also the same surfaces, 10, 11. The basis construction 16 or the place holder strip 16 runs between the individual pyramids 14.

FIG. 6 shows a construction element 1, which here consists of altogether five individual layers 2, 4, 23, 24, 25. Number 2 and 4 indicate the outer individual layers, whereas the middle layer 25 or the middle individual layer 25 with its partial shapes 26 and 27 on both sides at the same time serves as a bridge coupling for the individual layers 23, 24 and then the outer individual layers 2, 4. It can be seen that the so-called middle layer, meaning also the middle individual layer 25 has pyramids 14 or 14' that protrude to both sides to enable and facilitate the interlocking or connection with the correspondingly shaped individual layers 23 and 24 whereas then complementing hollow bodies 7, 8, 9 or partial hollow bodies 26, 27 are created.

Figure 7:
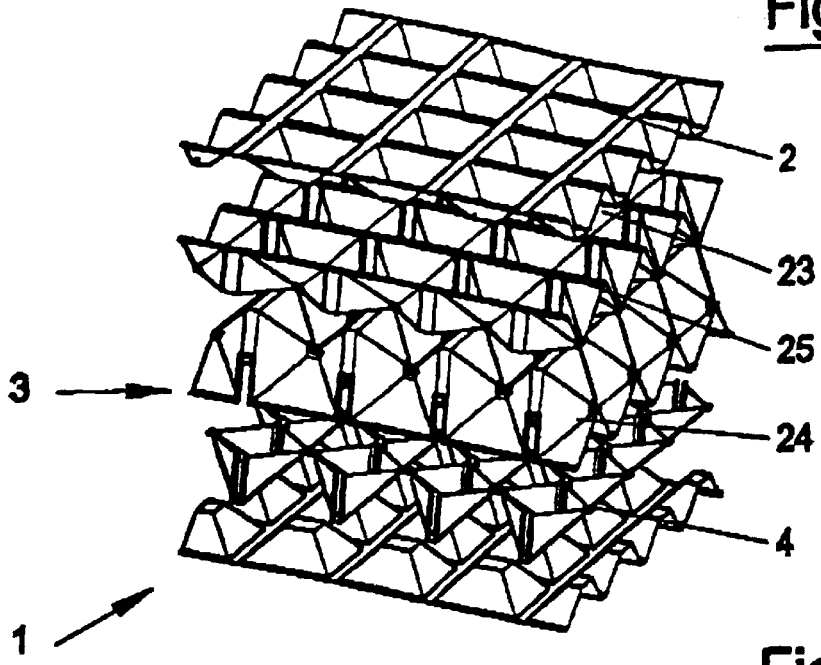

The construction element 1 that can be seen on FIG. 6 is shown on FIG. 7 shortly prior to putting it together, whereas this shall give an optical indication that the outer individual layers 2, 4 and the individual layers 23, 24 , 25 can be inserted into each other and interlocked that thus an extensive construction element of high stability and low weight is created whereas an additional advantage is the result of the insulating effect of such a construction element.

Figure 8:
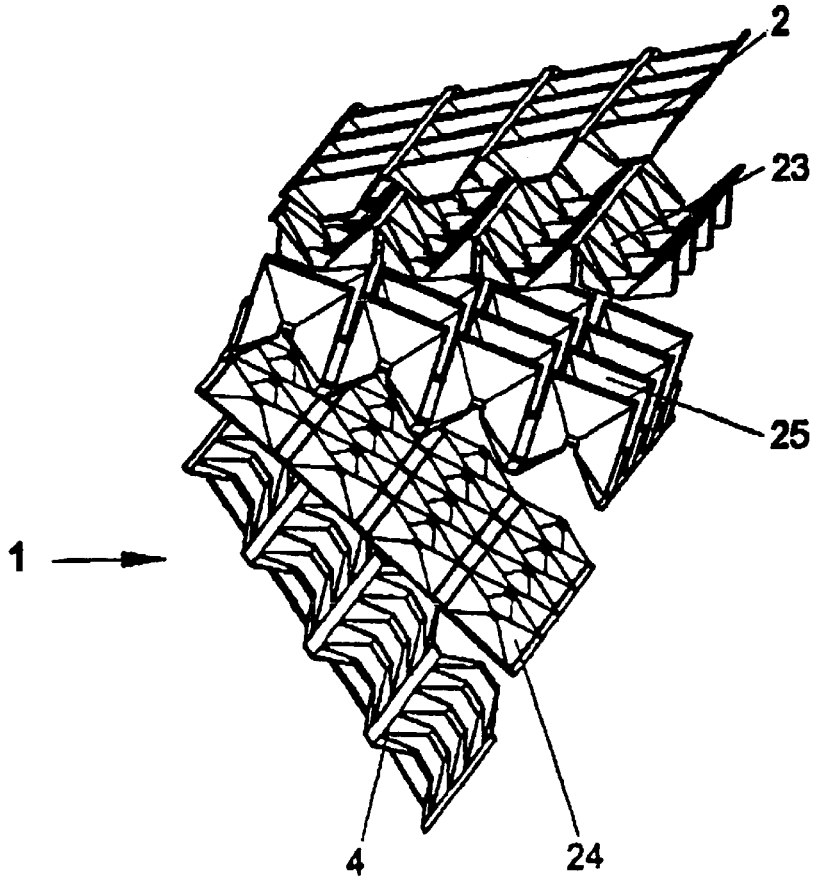

FIG. 8 finally shows the construction element according to FIG. 6 and FIG. 7 in a perspective view also shortly prior to putting it together whereas it becomes clear here that the outer individual layers 2, 4 feature no cover.

Figure 9:
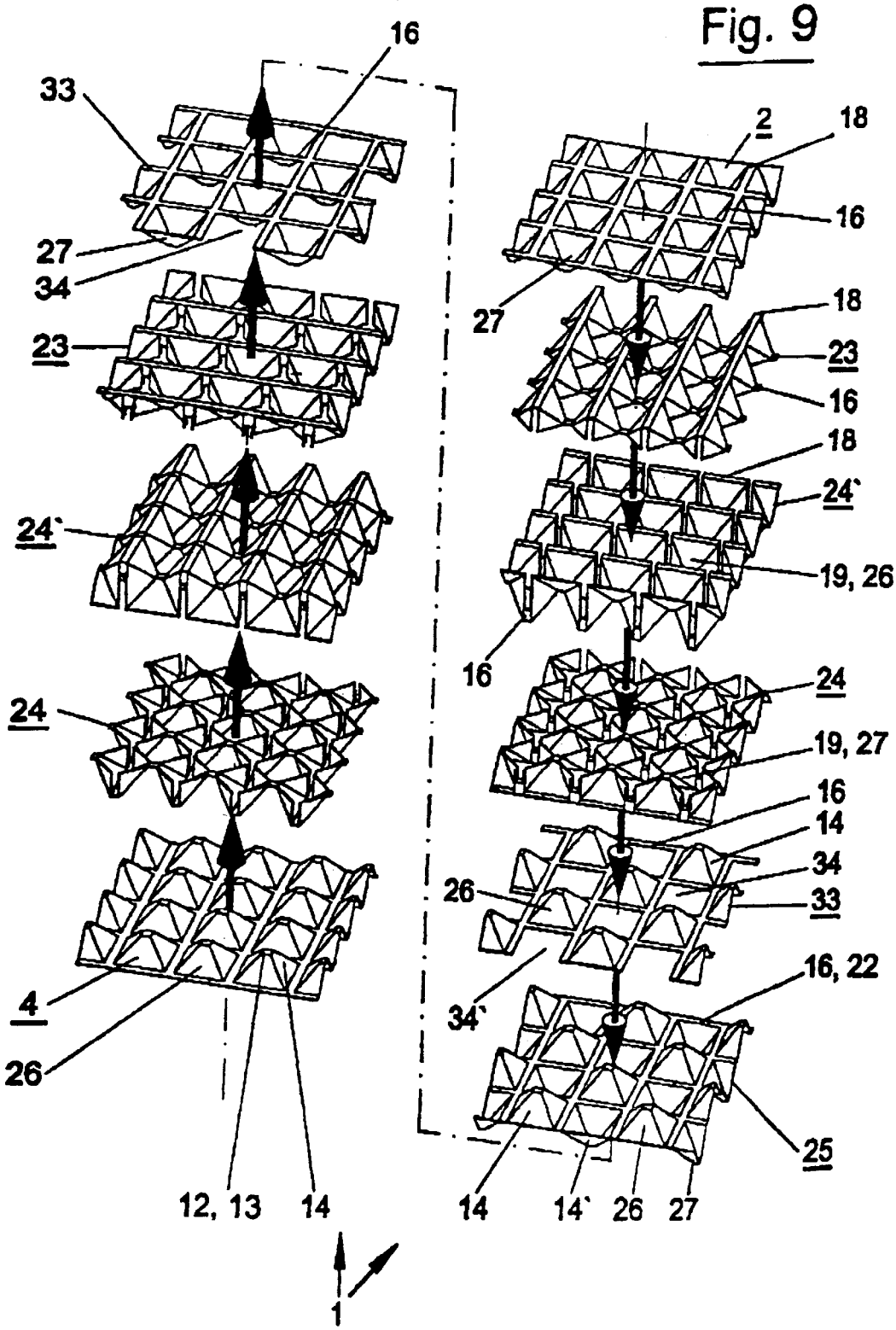

Finally, FIG. 9 shows a construction element that consists altogether of eleven individual layers 2, 4, 23, 24, 24' and 25 whereas the individual layers 23 as well as 24 and 25 are featured in double versions. The individual layers 2, 4 as well as the individual layers 23, 24 , 25 are known from the previous figures whereas here two adapter individual layers 33 have been added which turn the middle individual layer 25 on both sides into an outer individual layer 2 or 4 because it is equipped in turn with pyramids 14 and gaps 24 and therefore provides a coupling surface on both sides of the middle layer 25 which corresponds with those on the inner side 28 of the outer individual layers 2 or 4. Thus, a three-dimensional expansion of the corresponding construction element according to FIGS. 6, 7,8 is possible so that construction elements with any desired wall strength can be created.

The individual figures also show that the special design of the individual layers 2, 4, 23, 24, 25 and also 33 provide the possibility to create an extension in the plane through an correspondingly off set arrangement of the individual layers 2, 4, 23, 24, 25, 33 which makes an expansion of the construction element 1 to a very extensive construction element possible.

All specified characteristics, as well as those which can be seen on the drawings are regarded by themselves as well as in combination essential to the invention.

What is claimed is:

1. A construction apparatus comprising multiple individual layers, at least one of the multiple individual layers comprising a honeycomb structure having honeycomb elements, each individual layer forming a sheet or a foil of a part of the honeycomb structure and having a very thin wall, a base having protrusions extending above and/or below the base hollow or partial hollow bodies formed by the protrusions, the hollow or partial hollow bodies being shaped for interlocking or hooking into each other when inserted, the individual layers forming a wall with adjacent individual layers in a connection area along one surface, and the hollow or partial hollow bodies being disposed for distributing forces evenly onto all honeycomb elements.

2. The apparatus of claim 1, wherein each of the individual layers comprises the hollow or partial hollow bodies, wherein the hollow bodies of one individual layer corresponds with the hollow or partial hollow bodies of another individual layer, a middle individual layer formed by the hollow or partial hollow bodies of the different individual layers, the middle individual layer having a plurality of individual layers having corresponding surfaces therebetween.

3. The apparatus of claim 2, further comprising pyramids or mirrored double pyramids formed by the hollow or partial hollow bodies corresponding with the individual layers coupled to one another.

4. The apparatus of claim 3, wherein the pyramids mirrored double pyramids are formed by the individual layers such that adjacent pyramids or mirrored double pyramids are also built by inserting the individual layers thereby creating a flat surface, and a cross wall formed by a flat connection of the individual layers for absorbing forces from all sides.

5. The apparatus of claim 1, wherein the multiple individual layers comprise five individual layers coupled to form a combined element comprising a connecting middle layer forming a middle individual layer comprising positive and negative partial hollow bodies, an intermediary individual layer on each side of the middle layer, and an additional individual layer comprising partial hollow bodies on one side.

6. The apparatus of claim 5, wherein one or both intermediary individual layers further comprise an individual adapter layer and/or the connecting middle layer comprises a single adapter layer, and construction elements with any height and/or width on both sides of the layers forming a three-dimensional structure.

7. The apparatus of claim 6, wherein the individual adapter layer comprises positive hollow bodies or partial hollow bodies and gaps.

8. The apparatus of claim 7, wherein the individual layers comprise paper saturated with liquefied plastic, of aluminum, steel, or plastic foils.

9. The apparatus of claim 7, wherein the individual layers comprise woven foils, plastic threads or material comprising different fibers.

10. The apparatus of claim 3, further comprising edges leading to tops of the pyramids, wherein the edges are perforated and/or slit.

11. The apparatus of claim 1, wherein the hollow bodies comprise slanted surfaces forming the honeycomb structure, and wherein the hollow bodies are positioned in a beveled position on an edge.

12. The apparatus of claim 1, wherein the individual layers on outer sides comprise the hollow bodies or partial hollow bodies on inner sides of the individual layers and flat covers on outer sides of the individual layers.

13. The apparatus of claim 12, wherein upper and lower individual layers are made of flexible material.

14. The apparatus of claim 1, wherein the hollow bodies or partial hollow bodies form the honeycomb structure and are permanently or detachably connected with each other, by being welded together, glued, screwed or connected via frictional energy.

15. The apparatus of claim 14, wherein the hollow bodies or partial hollow bodies of the individual layers are shaped as pyramids and wherein the hollow bodies forming the honeycomb structure are shaped as double pyramids or a mirrored double pyramids.

16. The apparatus of claim 15, wherein the pyramids are spaced apart and form place holder stripes, and wherein the double pyramids are connected with each other via edge stripes disposed at edges parallel to a middle axis.

17. The apparatus of claim 16, wherein tops of the pyramids and/or the double pyramids are flattened.

18. The apparatus of claim 17, the flattened tops on the pyramids or double pyramids corresponds with the place holder stripes and/or the edge stripes for ensuring an extensive support.

19. The apparatus of claim 1, further comprising a wall formed by the hollow or partial hollow bodies and/or surfaces of the individual layers coupled by flexible material.

20. The apparatus of claim 19, further comprising a gaseous or liquid medium for partially or completely filling the hollow bodies after the individual layers are coupled.

21. The apparatus of claim 20, wherein the individual layers further comprise walls having gaps and/or the place holder stripes for allowing flow or circulation of the medium after the individual layers are coupled.

22. The apparatus of claim 20, further comprising connections for coupling the individual layers comprising neutral fibers connected with adjacent neutral fibers, with intermediary individual layers providing spaces therebetween, and wherein surfaces of the intermediary layers also have the connections.

* * * * *